US012491404B2

(12) United States Patent
Chou

(10) Patent No.: US 12,491,404 B2
(45) Date of Patent: Dec. 9, 2025

(54) STAIR STEPPER

(71) Applicant: Xiamen Zhoulong Sporting Goods Co., Ltd., Fujian (CN)

(72) Inventor: Yu-Chih Chou, Fujian (CN)

(73) Assignee: Xiamen Zhoulong Sporting Goods Co., Ltd., Xiamen (CN)

( * ) Notice: Subject to any disclaimer, the term of this patent is extended or adjusted under 35 U.S.C. 154(b) by 48 days.

(21) Appl. No.: 18/768,730

(22) Filed: Jul. 10, 2024

(65) Prior Publication Data

US 2025/0295950 A1 Sep. 25, 2025

(30) Foreign Application Priority Data

Mar. 20, 2024 (CN) ..... 202420547618.9

(51) Int. Cl.

| | |
|---|---|
| ***A63B 22/20*** | (2006.01) |
| ***A63B 21/00*** | (2006.01) |
| ***A63B 21/04*** | (2006.01) |
| ***A63B 21/055*** | (2006.01) |

(52) U.S. Cl.

CPC ..... *A63B 22/205* (2013.01); *A63B 21/0442* (2013.01); *A63B 21/0552* (2013.01); *A63B 21/153* (2013.01); *A63B 21/4034* (2015.10)

(58) Field of Classification Search

CPC ..... A63B 21/0442; A63B 21/0552; A63B 21/153; A63B 21/4034; A63B 22/205

See application file for complete search history.

(56) References Cited

U.S. PATENT DOCUMENTS

D263,490 S * 3/1982 Hickman ..... D21/670
4,900,012 A * 2/1990 Fu ..... A63B 23/03533 482/52
5,007,631 A 4/1991 Wang
5,267,922 A * 12/1993 Robinson ..... A63B 22/205 482/53
5,419,748 A * 5/1995 Snyderman ..... A63B 21/00072 482/52

(Continued)

FOREIGN PATENT DOCUMENTS

CN 201085881 Y 7/2008
CN 201186128 Y 1/2009

(Continued)

OTHER PUBLICATIONS

Decision on Invalidation Request Examination cited in CN202420547618.9, mailed Sep. 25, 2025, 22 pages.

*Primary Examiner* — Joshua Lee
(74) *Attorney, Agent, or Firm* — Cooper Legal Group, LLC

(57) ABSTRACT

The present invention relates to a stair stepper, including: a rack provided with two slide rails, each of the slide rails is slidably provided with one pedal component, where the two pedal components form linkage in the form of reverse synchronous movement; and a damping mechanism, including a linear elastic element, where the linear elastic element is straddled between the two slide rails, two ends of the linear elastic element are respectively connected to the pedal components. The linear elastic element expands or contracts with the reverse synchronous movement of the pedal components, to form a changing elastic force, and the changing elastic force acts on the pedal components, to form resistance to the movement of the pedal components.

10 Claims, 9 Drawing Sheets

(56) References Cited

U.S. PATENT DOCUMENTS

| | | | | |
|---|---|---|---|---|
| 7,621,849 | B1 * | 11/2009 | Tsai | A63B 21/0552 482/52 |
| 10,179,260 | B1 * | 1/2019 | Stearns | A63B 21/4034 |
| 10,272,286 | B2 * | 4/2019 | Liao Lai | A63B 22/04 |
| 11,458,358 | B1 * | 10/2022 | Stearns | A63B 22/001 |
| 11,980,788 | B1 * | 5/2024 | Maresh | A63B 23/03533 |
| 2018/0304116 | A1 * | 10/2018 | Ho | A63B 22/205 |
| 2020/0254303 | A1 * | 8/2020 | Stearns | A63B 21/4034 |
| 2021/0291016 | A1 * | 9/2021 | Zhou | A63B 21/0557 |

FOREIGN PATENT DOCUMENTS

| | | | |
|---|---|---|---|
| CN | 201394310 | Y | 2/2010 |
| CN | 201727888 | U | 2/2011 |
| CN | 204684550 | U | 10/2015 |
| CN | 205145508 | U | 4/2016 |
| CN | 205796438 | U | 12/2016 |
| CN | 213642989 | U | 7/2021 |
| CN | 116920339 | A | 10/2023 |
| CN | 220159152 | U | 12/2023 |
| TW | M393329 | U | 12/2010 |

* cited by examiner

STAIR STEPPER

CROSS-REFERENCE TO RELATED APPLICATIONS

This application claims priority to Chinese Patent Application 202420547618.9, filed on Mar. 20, 2024, which is incorporated herein by reference.

TECHNICAL FIELD

The present invention relates to the technical field of sports equipment, and in particular to a stair stepper.

BACKGROUND

When using a stair stepper, a user steps on two pedals and drives the two pedals to move up and down along rails alternately with an alternating force applied by two feet. A linkage mechanism is provided between the two pedals to ensure that the two pedals act simultaneously. To increase pedal resistance and obtain greater exercise intensity, some existing sports equipment with similar structures are usually provided with elastic ropes between the pedals and lower ends of racks to form resistance to the pedal. However, such structure can only form the resistance when the pedal rises from the middle, when the pedal moves downwards from the middle, a distance between the pedal and the lower end of the rack decreases, the elastic rope not only does not elongate and form resistance, but also droops, causing a specific safety hazard.

Some other sports equipment with similar structures use magnetic or mechanical resistance wheels to provide resistance to pedal movement. Although such sports equipment can overcome safety hazards caused by the elastic ropes, the structures are complicated and do not help structural layout of the equipment due to a lack of the elastic ropes.

In addition, angles of existing pedals are unchanged and cannot provide users with more diversified exercise manners.

SUMMARY

The present invention is intended to resolve problems in using existing stair steppers and provide a safe stair stepper with a simple structure.

To achieve the above purpose, technical solutions of the present invention are as follows: a stair stepper, including: a rack provided with two slide rails, where the two slide rails are arranged at intervals, each of the slide rails is slidably provided with one pedal component; and a linkage mechanism configured to link the two pedal components, where the two pedal components are driven to move synchronously in reverse directions by using the linkage mechanism; and further provided with a damping mechanism configured to provide resistance to the pedal components, where the damping mechanism includes a linear elastic element, the linear elastic element is straddled between the two slide rails, two ends of the linear elastic element are respectively connected to the pedal components, the linear elastic element expands or contracts with the reverse synchronous movement of the pedal components, to form a changing elastic force, and the changing elastic force acts on the pedal components, to form resistance to the movement of the pedal components.

Beneficial effects of the present invention are as follows.

1. The damping mechanism with the linear elastic element is provided, so that resistance acting by the damping mechanism on the pedal component is changed as a position of the pedal component on the slide rail is changed, that is, the resistance is adjusted as a movement stroke of the pedal component is changed, reducing a speed of the pedal component at the end of the stroke, alleviating the impact of the pedal, and improving movement comfort.

2. The two ends of the linear elastic element are straddled between the two slide rails and are respectively connected to the pedal components, no matter which position the pedal component moves to, the linear elastic element is always in a tensioning state without drooping, which can prevent a safety hazard caused by drooping of the elastic rope.

3. The two ends of the linear elastic element are respectively connected to the pedal components, and as the pedal components are far away from each other, the linear elastic element stretches, and correspondingly the elasticity is increased. The elasticity can prevent the pedal components from continuing to move and form resistance to the pedal components, and can also become a pulling force for a next stroke when the pedal components move to ends of one stroke (the ends of the stroke are also starts of a next stroke), which can cushion the impact of the pedal components, and can also push the pedal components to start, making the movement smoother and further improving movement comfort.

4. The elastic rope can provide enough elasticity in case of a large amount of expansion or contraction, and the structure occupies small space, helping overall layout of the stair stepper, and the reversing part at the second end of the connecting component can extend the length of the linear elastic element such as the elastic rope in a natural state, so that the amount of expansion is more reasonable, and the service life of the linear elastic element can be prolonged.

5. Angle adjustment between the pedal part and the base part can enable the user's feet to tilt at various angles, providing the user with more use manners, and meeting diversified movement needs of the user.

6. The locking mechanism formed by the inserting member, the first adjusting holes, and the second adjusting holes have a simple structure, and adjustment is easily and rapidly performed, helping the user quickly adjust the angle of the pedal part.

7. The inserting rods and the marbles match to make the inserting members detachably connected relative to the adjusting holes (the first adjusting holes and/or the second adjusting holes). Depending on the elastic expansion or contraction of the marbles relative to the inserting rods, the inserting members can be limited to prevent the inserting members from falling and causing the locking mechanism to loose and be easily pulled out or inserted.

Figure 1:
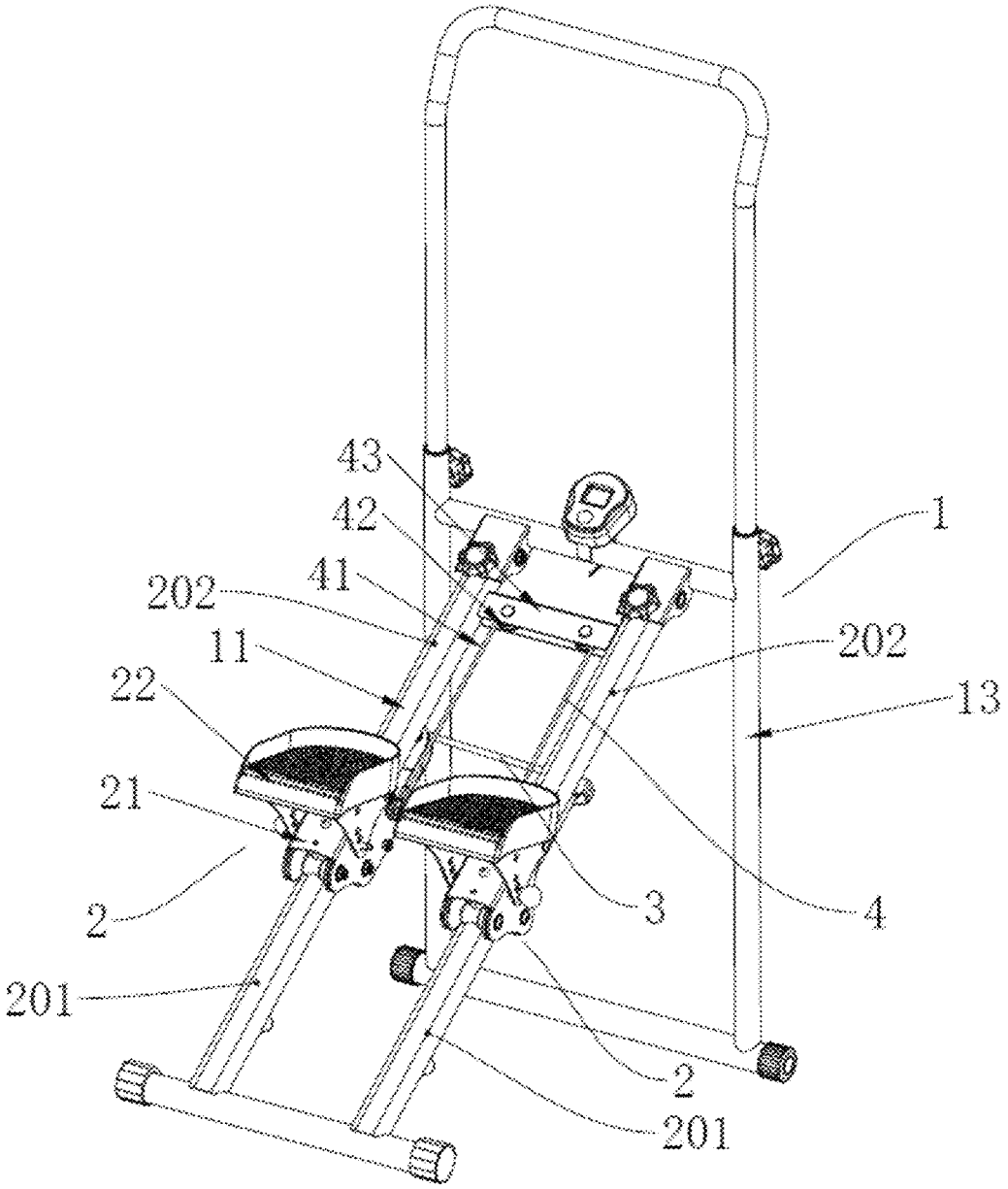
FIG. 1 is a three-dimensional view according to an embodiment of the present invention.

1. rack, 11 slide rail, 12 limiting rod, 13 support frame, 2 pedal component, 21. base part, 211. bottom plate, 2110. first adjusting hole, 212. rolling wheel, 22. pedal part, 221. stepping member, 222. connecting member, 2220. second adjusting hole, 2220A. second adjusting hole I, 2220B. second adjusting hole II, 2220C. second adjusting hole III, 2220D second adjusting hole IV, 23. inserting member, 231. inserting rod, 232. marble, 3. damping mechanism, 31. elastic rope, 32. connecting component, 321. reversing part, 322. support rod, 4. linkage mechanism, 41. steel wire rope, 42. pulley, 43. connecting rod;

201. first endpoint, 202. second endpoint.

DESCRIPTION OF EMBODIMENTS

To further illustrate embodiments, the present invention is provided with accompanying drawings. The drawings are a part of the disclosure of the present invention, and are mainly used to illustrate the embodiments and can be used with reference to related descriptions in the specification to explain operating principles of the embodiments. With reference to the content, those skilled in the art shall understand other possible implementations and advantages of the present invention. Components in the drawings are not drawn to scale, and similar component symbols are usually used to represent similar components.

Figure 2:
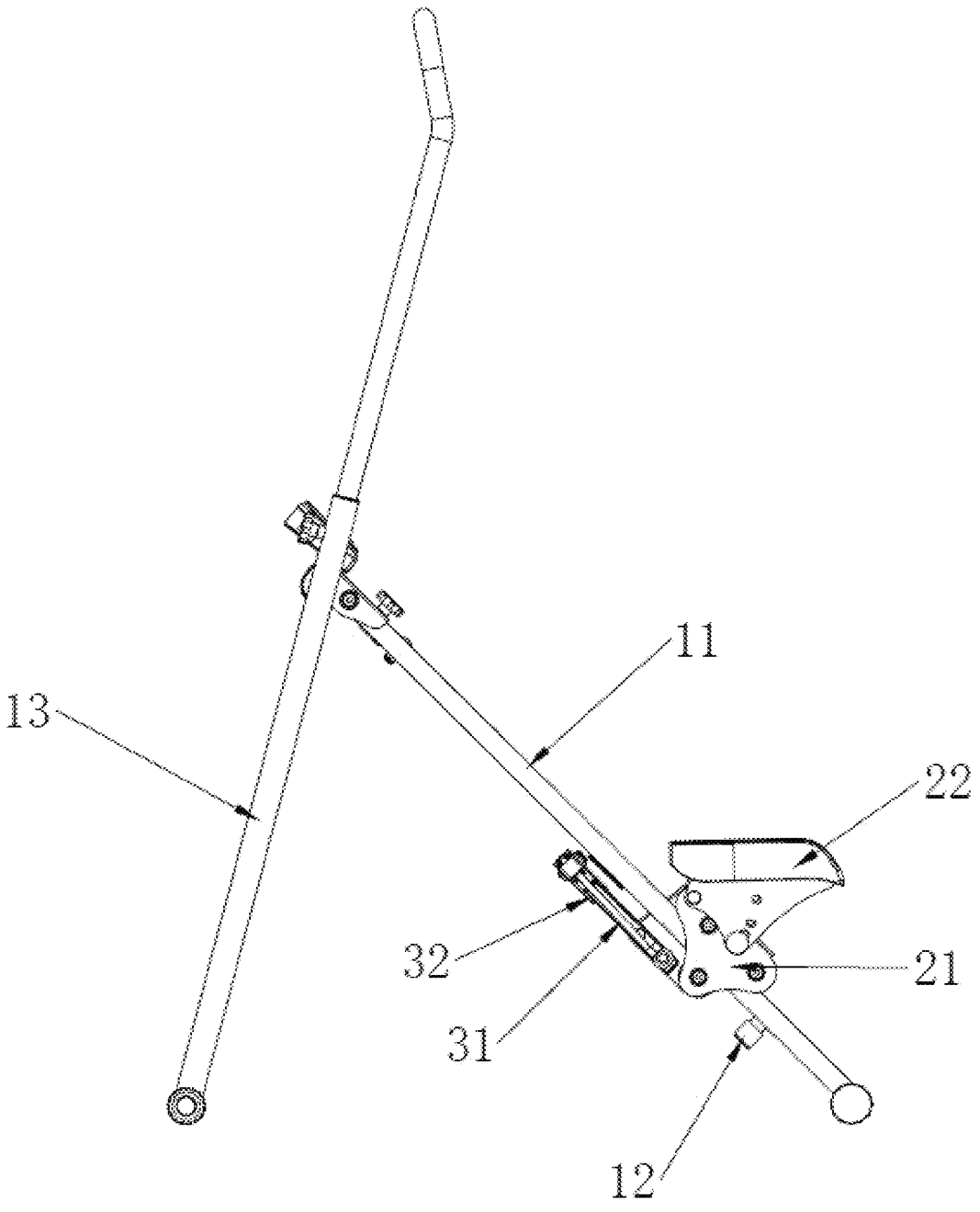
FIG. 2 is a side view according to an embodiment of the present invention.

Refer to FIG. 1 and FIG. 2, the present invention discloses a stair stepper, including: a rack 1 provided with two slide rails 11, where the two slide rails 11 are arranged at intervals, each slide rail 11 is slidably provided with a pedal component 2; a damping mechanism 3 configured to provide resistance to the pedal components 2; and a linkage mechanism 4 configured to link the two pedal components 2, where the two pedal components 2 are driven by the linkage mechanism 4 to move synchronously in reverse directions. The damping mechanism 3 includes a linear elastic element, the linear elastic element is straddled between the two slide rails 11, two ends of the linear elastic element are respectively connected to the pedal components 2. The linear elastic element expands or contracts with the reverse synchronous movement of the pedal components 2, to form a changing elastic force. The changing elastic force acts on the pedal components 2, to form resistance to the movement of the pedal components 2. The linkage mechanism 4 includes a steel wire rope 41 connected to a pedal component 2 at both ends, and the middle of the steel wire rope 41 is wound around a pulley 42 disposed at the top of the slide rail 11. The pulley 42 is disposed between the two slide rails 11 through a connecting rod 43.

Refer to FIG. 1, FIG. 2, FIG. 10, and FIG. 11, the slide rail 11 is a straight and elongated structure. The pedal component 2 moves back and forth linearly along the slide rail 11. One stroke of the pedal component 2 means movement from a first end to a second end opposite to the first end within a range of linear motion. Movement directions of two consecutive strokes are opposite. Each slide rail 11 is provided with a limiting rod 12 at the bottom, and one pedal component 2 reaches a first endpoint 201 of one stroke when moving downwards until touching the limiting rod 12, and one opposite pedal component 2 is now at a second endpoint 202 of the stroke. When the pedal component 2 moves from the second endpoint 202 to the first endpoint 201 along the slide rail 11, a start of the stroke is the second endpoint 202, and an end of the stroke is the first endpoint 201. When the pedal component 2 moves from the first endpoint 201 to the second endpoint 202 along the slide rail 11, a start of the stroke is the first endpoint 201, and an end of the stroke is the second endpoint 202.

According to the present invention, the damping mechanism 3 with the linear elastic element is provided, so that resistance acting by the damping mechanism 3 on the pedal component 2 is changed as a position of the pedal component 2 on the slide rail 11 is changed, that is, the resistance is adjusted as a movement stroke of the pedal component 2 is changed, and the resistance is the greatest when the pedal component 2 moves to the end of the stroke, reducing a speed of the pedal component 2 at the end of the stroke, alleviating the impact of the pedal, and improving movement comfort. In addition, a speed of the pedal component 2 in a later stage of the stroke may also be reduced until the speed drops to zero when the pedal component 2 reaches the end of the stroke.

The linear elastic element means an elastic element that follows the Hooke's law and has a linear relationship between elasticity and deformation, such as an elastic rope, a spring, or the like.

Refer to FIG. 1 to FIG. 5, the linear elastic element in this example is the elastic rope 31. Two ends of the elastic rope 31 are respectively connected to the pedal components 2, and resistance is synchronously applied to the two pedal components 2 through an elastic force of the elastic rope 31. The damping mechanism 3 further includes connecting components 32 extending along a length direction of the slide rails 11. A first end of the connecting component 32 is firmly connected to the pedal component 2, and a second end of the connecting component 32 is provided with a reversing part 321. The two ends of the elastic rope 31 are respectively connected to first ends of the connecting components 32, and the middle of the elastic rope 31 is wound around the reversing part 321. The connecting component 32 includes an elongated support rod 322, a first end of the support rod 322 is firmly connected to the pedal component 2. The reversing part 321 is a rolling wheel disposed at a second end of the support rod 322, so that the first end of the support rod 322 becomes the first end of the connecting component 32, and the second end of the support rod 322 becomes the second end of the connecting component 32. The elastic rope 31 has two ends, namely, a first end 311 and a second end 312. The first end of the elastic rope 31 is connected to a first end of a support rod 322 (a first support rod 322-1 in FIG. 3), and the second end penetrates the two reversing parts 321 and is connected to the other support rod 322 (a second support rod 322-2 in FIG. 3). In this example, the first end of the connecting component 32 is provided with a connecting nail 323, and the elastic rope 31 is hooked on the connecting nail 323, to form a detachable connection between the elastic rope 31 and the connecting component 32, so that the elastic rope 31 that is damaged can be replaced easily, and a hooked connection manner facilitates disassembly and assembly, a user can replace the hook by himself, reducing maintenance and replacement costs for the present invention. In another embodiment, the elastic rope 31 may alternatively be connected to the first end of the support rod 322 through a screw, thereby forming a detachable connection with the connecting component 32 and indirectly forming a detachable connection with the pedal component 2. Alternatively, the elastic rope 31 may be directly connected to one side of a bottom plate 211 of the pedal component 2 through a screw, forming a detachable connection with the pedal component 2, thereby implementing disassembly, assembly, and replacement of the elastic rope 31.

The two ends of the elastic rope 31 are respectively connected to the pedal components 2. When the pedal components 2 are in the middle of a stroke, a distance between the pedal components 2 is the shortest. In this case, the elastic rope 31 is in a natural elongation state, and elasticity is approximate to zero. As the pedal components 2 move in reverse directions, the distance between the pedal components 2 gradually increases until the distance is the greatest when the pedal components 2 moves to the ends of the stroke. In this case, the elongation of the elastic rope is the greatest, an elastic force is also the greatest, and resistance of the damping mechanism 3 to the pedal component 2 is also the greatest. The elastic force tends to reduce the distance between the two pedal components 2, thereby forming a pushing force for a next stroke of the pedal components 2, reducing a stepping force that the user needs to apply to the pedal components 2, making the user's movement easier and smoother. In addition, because the two pedal components 2 are connected by a same elastic rope 31, elastic forces exerted by the elastic rope 31 on the two pedal components 2 are equal, helping maintain movement balance.

In this example, the elongated support rod 322 and the reversing part 321 are used to enable the elastic rope 31 to be extended for a specific distance along a length direction of the slide rail 11 and to be straddled between the two slide rails 11, extending the length of the elastic rope 31 to provide sufficient elongation, thereby achieve good sports experience. In another embodiment, if the elastic rope 31 is directly connected to the two pedal components 2 without the support rod 322, the length of the elastic rope 31 is insufficient, so that sufficient elongation is not easily obtained. As a result, the elastic rope 31 is excessively extended for a long time, losing elasticity and shortening the life of the elastic rope 31, or the stroke of the pedal component 2 is shortened. If the length of the elastic rope 31 is disposed to be long without the support of the reversing part 321, the elastic rope 31 may entangle at a position where the distance between the two pedal components 2 is short, affecting normal use of the stair stepper. The length of the elastic rope 31 is determined based on the distance between the pedal components 2, can be selected by those skilled in the art according to an actual situation, which is not described herein.

In this example, the reversing part 321 is a rolling wheel, and the rolling wheel rotates with the expansion or contraction of the elastic rope 31. Rolling friction is formed between the rolling wheel and the elastic rope 31, and the friction is small, which can improve the life of the elastic rope 31 and reduce the influence on the movement of the pedal component 2. In another embodiment, the reversing part 321 may alternatively be a fastened block fastened to one end of the support rod 322 or a relatively rounded end of second ends of the support rods 322. In this case, relative movement between the elastic rope 31 and the reversing part 321 is relative sliding.

In addition, the elastic rope 31 may be replaced by a linear elastic element such as a spring, and the spring extends as the distance between the two pedal components 2 increases, thereby exerting resistance to the pedal components 2.

In the above embodiment, two ends of the linear elastic element (the elastic rope 31 or spring) are respectively connected to the pedal components 2, thereby exerting equal resistance to the two pedal components 2 by using the linear elastic element. In another embodiment, alternatively, one pedal component 2 may be correspondingly provided with one linear elastic element, and a first end of the elastic rope 31 or spring is fastened to the pedal component 2, and a second end opposite the first end is fastened to the top of the slide rail 11. When not in use by the user, the gravity of the pedal component 2, a support force of the slide rail 11 against the pedal component 2, and elasticity of the linear elastic element maintains the pedal component 2 on an upper part (that is, an upper end of one stroke) of the slide rail 11. When the user steps on the pedal component 2 to exert a force on the pedal component 2, the pedal component 2 slides down along the slide rail 11, and the elastic force of the linear elastic element increases, thus forming resistance to the pedal component 2. In addition, the elastic force is the greatest when the pedal component 2 moves to a lower part (that is, the end of the stroke) of the slide rail 11. Whether the two ends of the linear elastic element are respectively connected to the pedal components 2 or each pedal component 2 is provided with one linear elastic element, when the pedal components 2 move to ends of one stroke, positions of the pedal components 2 are also starts of a next stroke, and an elastic force of the linear elastic element forms a pushing force for the next stroke, which can exert a tension on the pedal components 2 to accelerate a speed of the pedal components 2, thereby forming a pushing force for user movement, and providing a smoother movement process.

Figure 3:
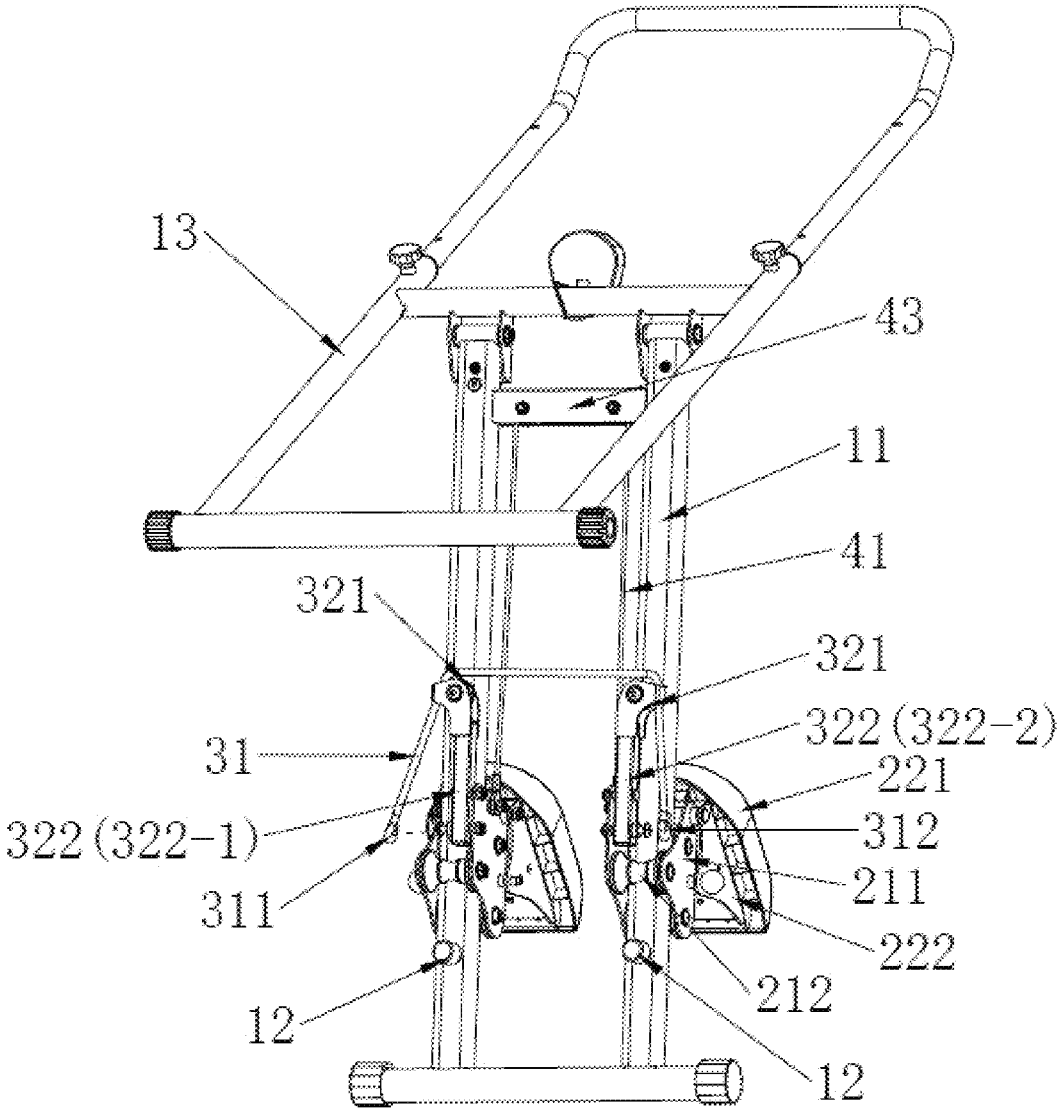
FIG. 3 is a three-dimensional view from another angle of view according to an embodiment of the present invention, where an elastic rope is in a partially explosive state.
Figure 4:
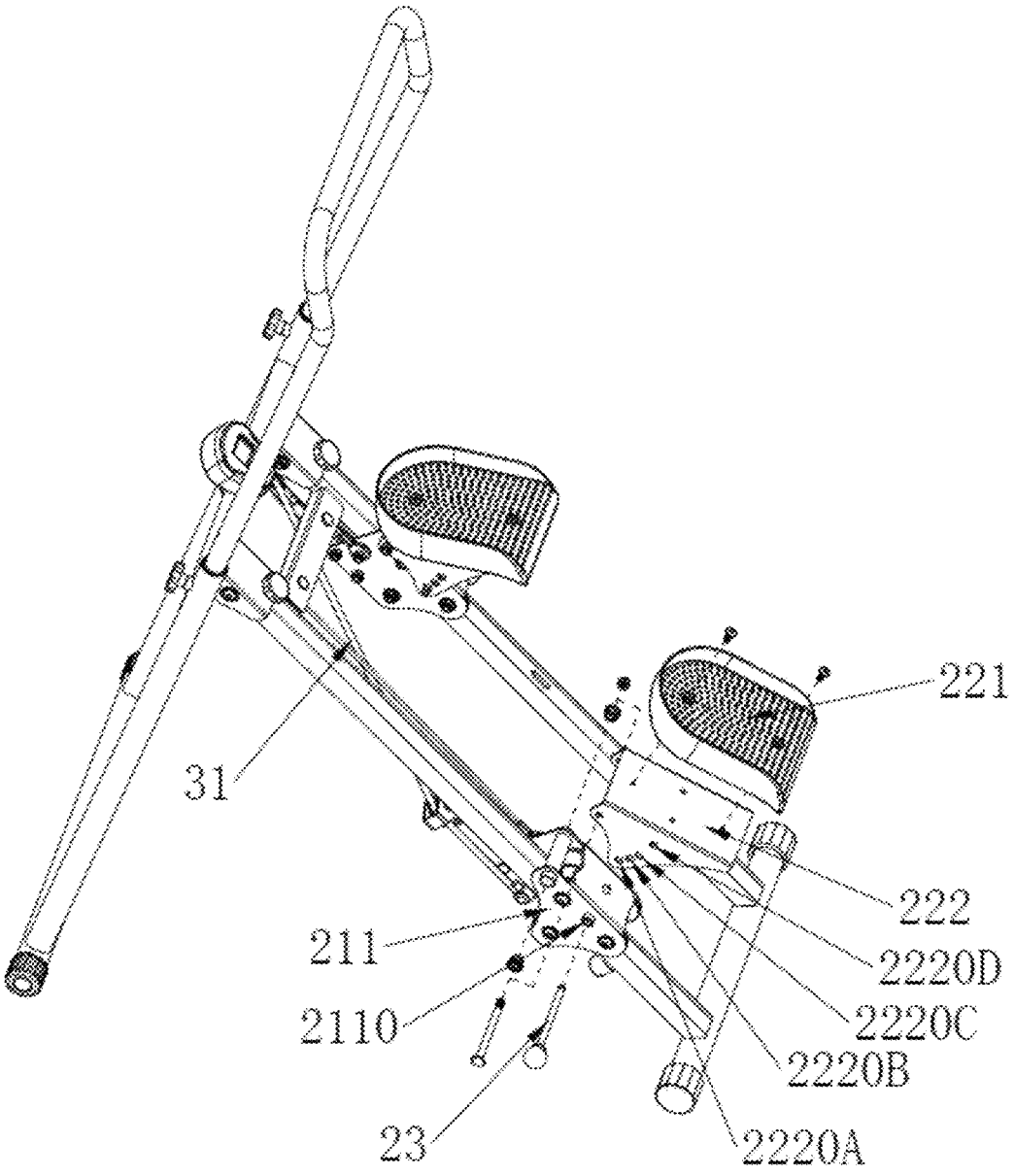
FIG. 4 is a partially exploded view according to an embodiment of the present invention.
Figure 5:
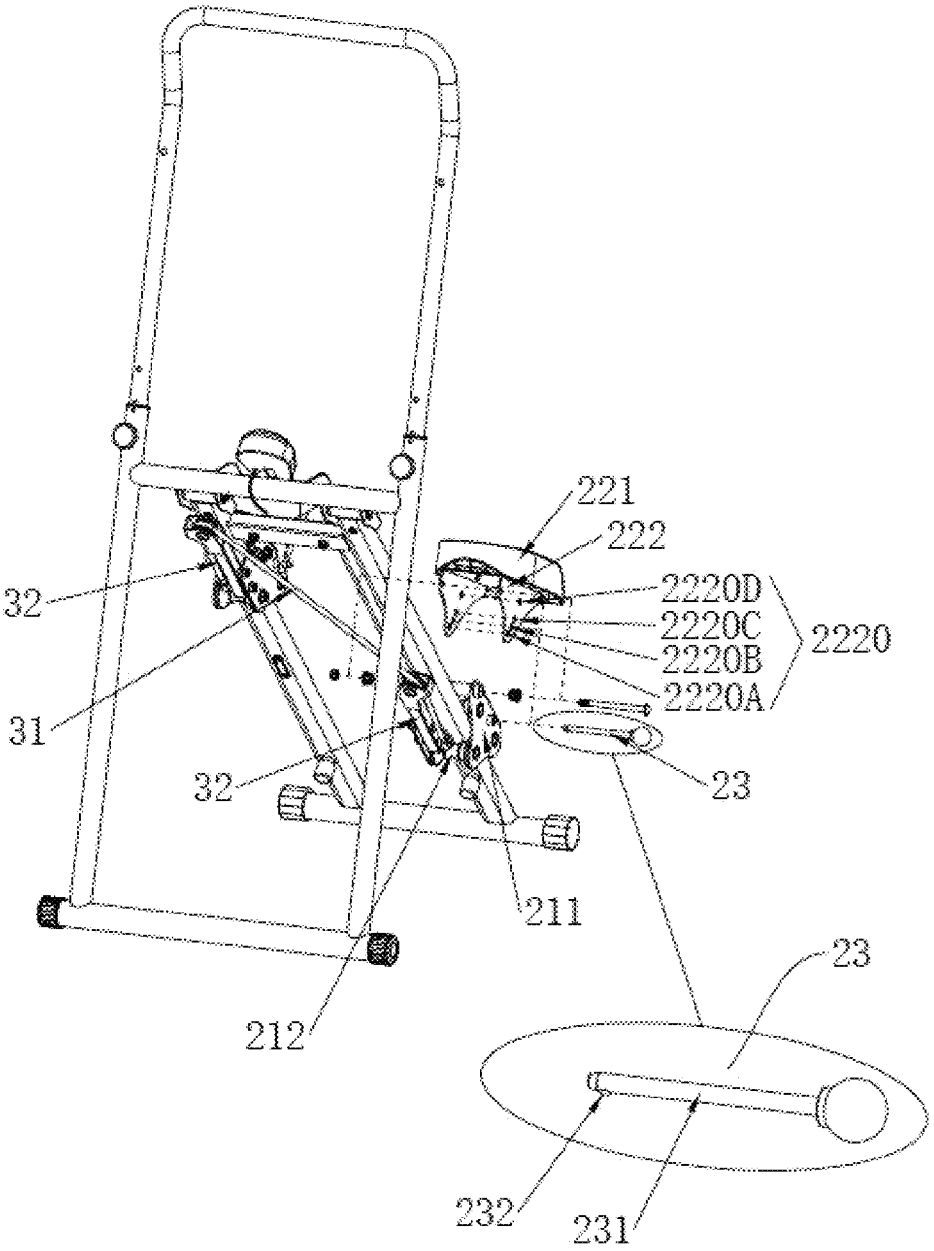
FIG. 5 is a partially exploded view from another angle of view of FIG. 4.
Figure 6:
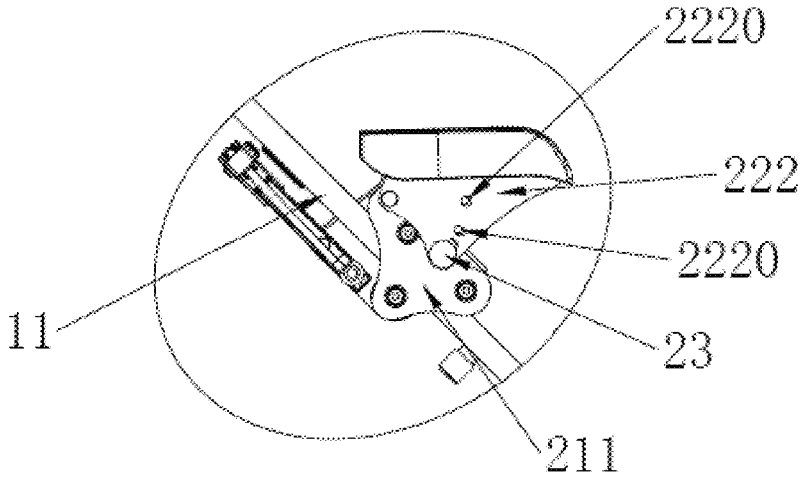
FIG. 6 is a partial view of a pedal component in a first gear according to an embodiment of the present invention.
Figure 7:
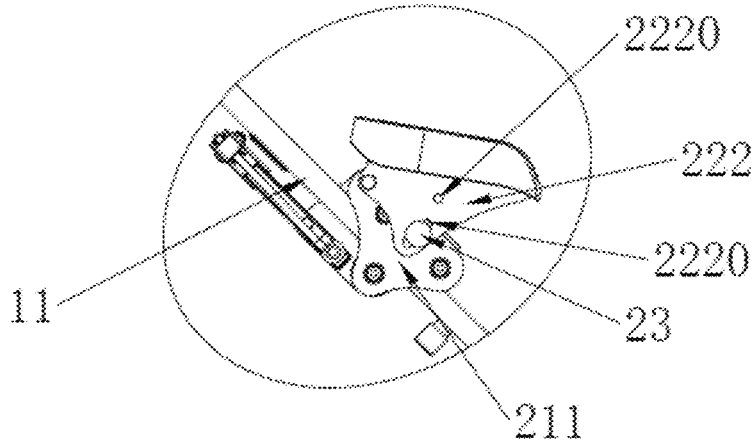
FIG. 7 is a partial view of the pedal component in a second gear according to an embodiment of the present invention.
Figure 8:
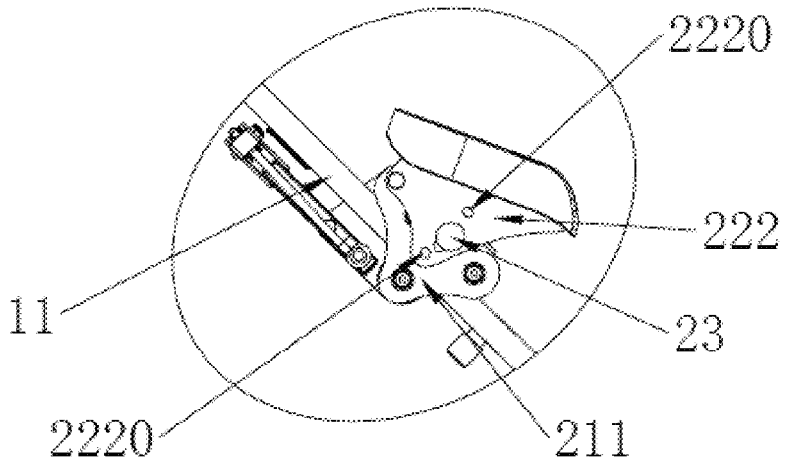
FIG. 8 is a partial view of the pedal component in a third gear according to an embodiment of the present invention.
Figure 9:
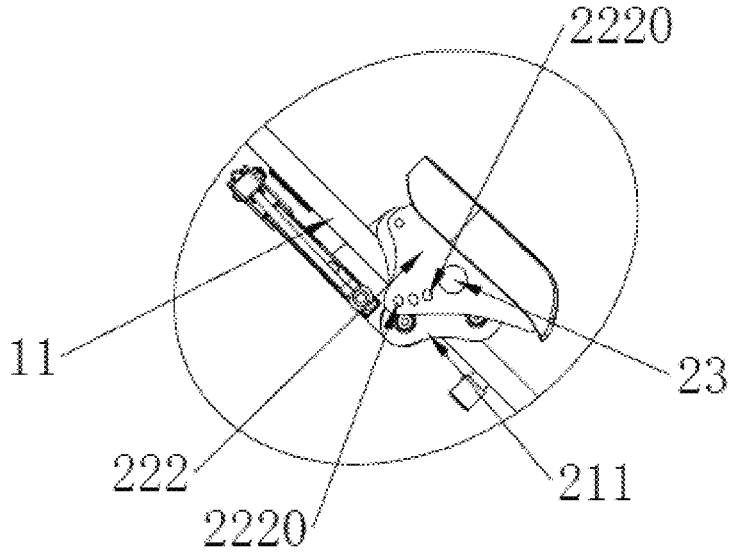
FIG. 9 is a partial view of the pedal component in a fourth gear according to an embodiment of the present invention.

Refer to FIG. 3 to FIG. 5, the pedal component 2 includes a base part 21 and a pedal part 22. The base part 21 is slidably connected to the slide rail 11, the pedal part 22 is hinged with the base part 21, a locking structure is provided between the pedal part 22 and the base part 21, an angle between the pedal part 22 and the base part 21 is adjusted through hinging between the pedal part 22 and the base part 21, and the angle is locked by using the locking structure, thereby adjusting an angle of the pedal part 22 relative to the slide rail 11. Therefore, a variety of angles can be provided to meet diversified movement needs of the user, and the pedal part 22 can be placed at a position closest to the slide rail 11 for ease of storage and transportation.

The base part 21 includes a U-shaped bottom plate 211, the bottom plate 211 is provided with three rolling wheels 212, and the three rolling wheels 212 are disposed on two opposite sides of the slide rail 11, to form a slidable connection between the base part 21 and the slide rail 11. The pedal part 22 includes a stepping member 221 and a connecting member 222 disposed at the bottom of the stepping member 221, the stepping member 221 is firmly connected to the connecting member 222, and the connecting member 222 is also a U-shaped plate structure, with one end hinged with the bottom plate 211. The size of the connecting member 222 is slightly larger than the size of the bottom plate 211, so that the connecting member 222 can cover the bottom plate 211. The bottom plate 211 is provided with a group of first adjusting holes 2110, and the connecting member 222 is provided with a plurality of groups of second adjusting holes 2220, any group of second adjusting holes 220 and the first adjusting holes 2110 may be coaxial by using hinging between the bottom plate 211 and the connecting member 222. Inserting members 23 are also provided, and the inserting members 23 are inserted into the first adjusting holes 2110 and the second adjusting holes 220 that are coaxial, to fasten an angle between the bottom plate 211 and the connecting member 222, that is, a relative angle between the pedal part 22 and the base part 21 is fastened, thus fastening an angle between the pedal part 22 of the pedal component 2 and the slide rail 11.

Refer to FIG. 6 to FIG. 9, the first adjusting holes 2110, the second adjusting holes 2220, and the inserting member 23 form the locking mechanism. There are four groups of second adjusting holes 2220, a second adjusting hole I 2220A, a second adjusting hole II 2220B, a second adjusting hole III 2220C are respectively corresponding to a first gear, a second gear, and the third gear of the pedal part 22, and the user selects any group of the second adjusting holes 2220 according to the need to adjust a gear of the pedal part 22. For example, when muscles on a rear side of a lower leg of a user need to be stretched, the second gear (corresponding to the second adjusting hole II 2220B) or the third gear (corresponding to the second adjusting hole III 2220C) may be used, or if sliding is only needed, the first gear (corresponding to the second adjusting hole I 2220A) may be selected. In this case, the angle between the pedal part 22 and the slide rail 11 is the greatest. The second adjusting hole IV 2220D is a storage gear corresponding to the pedal part 22, and the angle between the pedal part 22 and the slide rail 11 is the smallest, to help transportation.

In this example, the angle between the pedal part 22 and the base part 21 is adjusted in a multi-gear manner, helping the user adjust a corresponding gear according to needs. For a user with less exercise experience, an exact angle can be achieved without adjustment for several times, but only one of the gears is selected, which can also reduce an exercise injury caused by inadequate angle adjustment. In another embodiment, stepless adjustment may alternatively be provided, for example, a screw adjustment mechanism is disposed between the pedal part 22 and the base part 21, to help precise adjustment of the angle of the pedal part 22.

Refer to FIG. 5. The inserting member 23 includes an inserting rod 231 and a marble 232 disposed at one end of the inserting rod 231. The marble 232 elastically protrudes from a side wall of the inserting rod 231, and the marble 232 elastically expands or contracts relative to the inserting rod 231 under the action of the first adjusting hole 2110 and the second adjusting hole 2220. During insertion or pull-out, the inserting member 23 shrinks inward when passing through the first adjusting hole 2110 and the second adjusting hole 2220, so that the inserting member 23 can pass through the holes smoothly. When the inserting member 23 is inserted in place, the marble 232 protrudes to form limiting, to prevent the inserting member 23 from slipping out in a case of tilt or vibration of the stair stepper. In another embodiment, a nut may alternatively be used to prevent the inserting member 23 from slipping out after inserted in place. Compared with the manner in which the nut prevents the inserting member 23 from slipping out, the marble 232 in this example is used more easily, and the marble 232 can be locked inward by slightly increasing the strength when the inserting member 23 is inserted or pulled out.

Refer to FIG. 1 and FIG. 2. The rack 1 further includes a support frame 13, and the support frame 13 is connected to the slide rails 11 to form a V-shaped support for the stair stepper. The top of the support frame 13 forms a handrail for the stair stepper. It should be noted that the handrail is not necessary, and the top of the support frame 13 may be disposed to connect to the slide rails 11, and the user stands on the stair stepper for use.

The working flow of the present invention is as follows.

Refer to FIG. 1. In an initial state, the two pedal components 2 are in the middle of one stroke.

Figure 10:
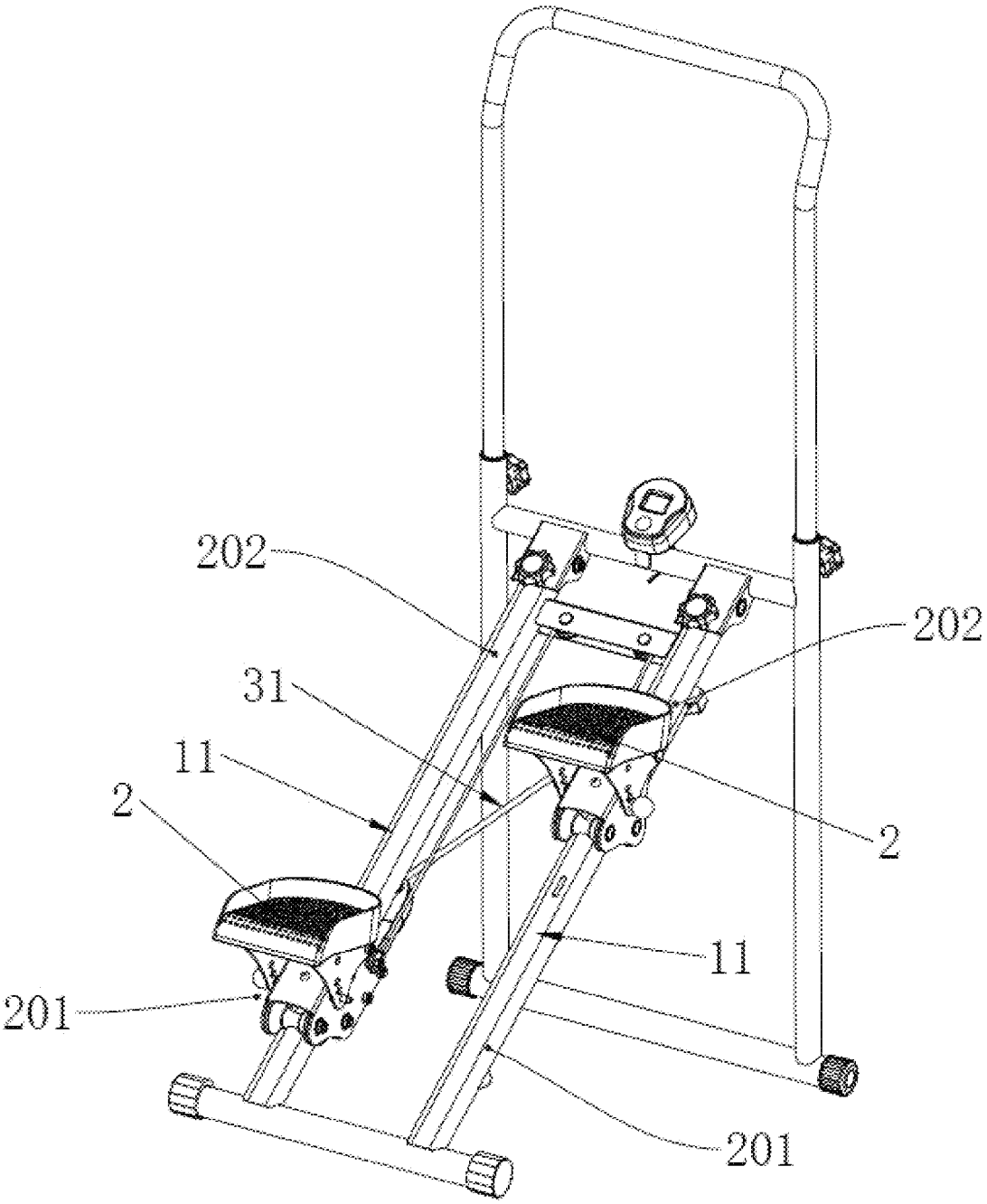
FIG. 10 is a first diagram of a use state according to an embodiment of the present invention.

Refer to FIG. 10, when the user steps on the pedal parts 22 and applies a force to the pedal component 2 on the left of the figure, the pedal component 2 moves towards the first endpoint 201 along the slide rail 11, while the pedal component 2 on the right moves towards the second endpoint 202 along the slide rail 11. During movement, the elastic rope 31 is stretched, and elasticity of the rope gradually increases to form resistance to the two pedal components 2, until the pedal component 2 on the left reaches the first endpoint 201, and the pedal component 2 on the right reaches the second endpoint 202 (the two pedal components 2 reach ends of the stroke), and the elasticity is the greatest.

Figure 11:
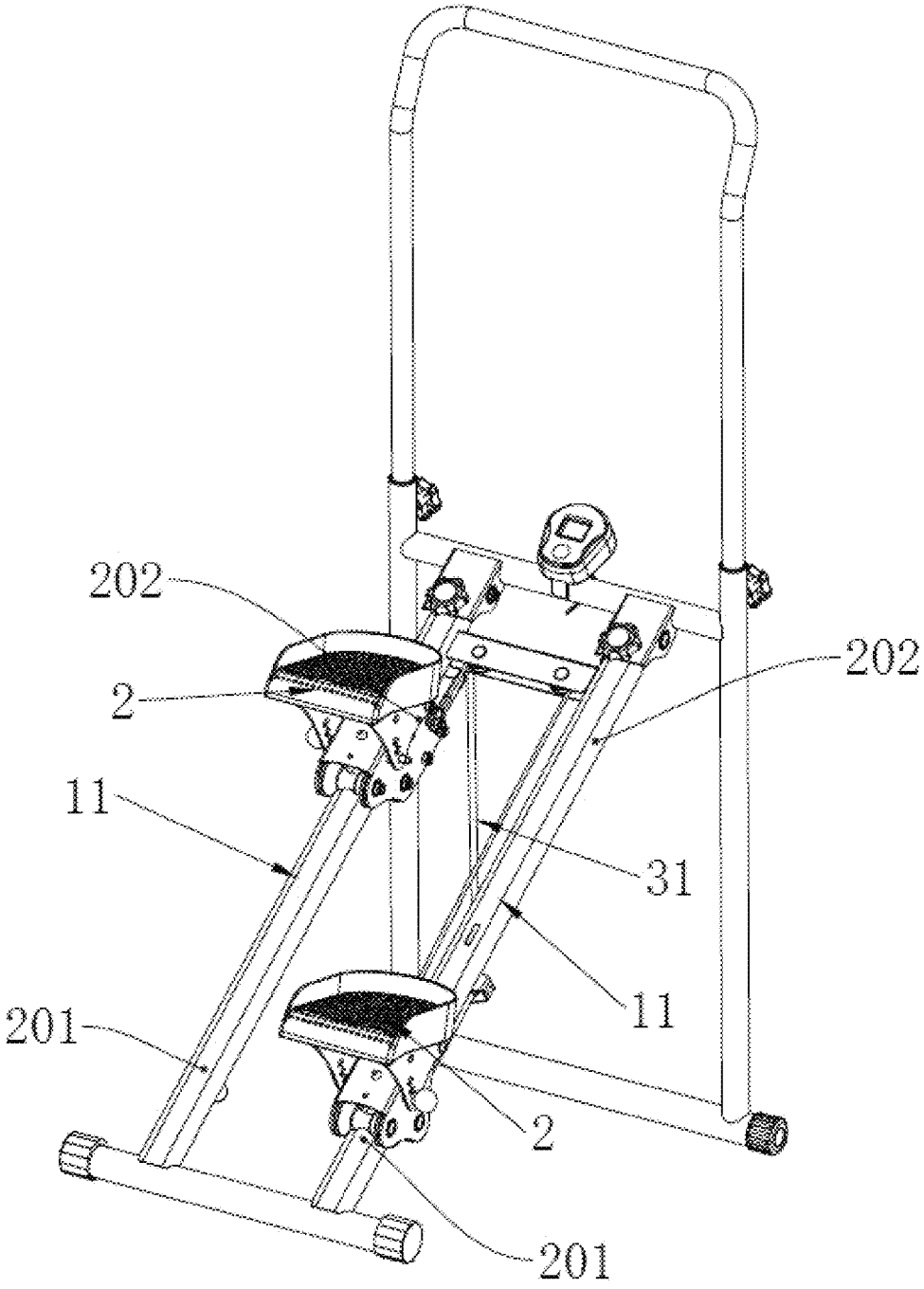
FIG. 11 is a second diagram of a use state according to an embodiment of the present invention.

Refer to FIG. 11. If the user applies a force to pedal component 2 on the right of the figure, the pedal component 2 moves from the second endpoint 202 to the first endpoint 201 along the slide rail 11, while the pedal component 2 on the left moves from the first endpoint 201 to the second endpoint 202 along the slide rail 11. When the two pedal components 2 move to the middle of the stroke, the elastic rope 31 is shortened to a natural length, and the elastic force of the elastic rope 31 is in a same direction as the pedal components 2, so that the elastic force forms a pulling force for movement of the pedal components 2. As the two pedal components 2 continue to move to the ends of the stroke (the pedal component 2 on the right moves to the first endpoint 201, and the pedal component 2 on the left moves to the second endpoint 202), the elastic rope 31 is stretched again, and elasticity of the elastic rope 31 gradually increases, to form the resistance to the two pedal components 2.

As the user's feet alternately step and exert forces, the two pedal components 2 respectively perform linear reciprocating motion, and the elastic rope 31 is repeatedly stretched or shortened, and the elastic force also changes accordingly.

Although the present invention is specifically demonstrated and introduced with reference to preferred implementation solutions, it should be understood by those skilled in the art that the remaining unstated part is prior art, and that all changes made to the present invention in form and detail within the spirit and scope of the present invention as defined by the attached claims shall fall within the protection scope of the present invention.

The invention claimed is:

1. A stair stepper, comprising:

a rack provided with two slide rails, wherein the two slide rails are arranged at intervals, and each of the two slide rails is slidably provided with one pedal component; and a linkage mechanism configured to link the two pedal components, wherein the two pedal components are driven to move synchronously in reverse directions by using the linkage mechanism; and a damping mechanism configured to provide resistance to the two pedal components, where the damping mechanism comprises a linear elastic element, the linear elastic element is straddled between the two slide rails, two ends of the linear elastic element are respectively connected to the two pedal components, the linear elastic element expands or contracts with the movement of the two pedal components synchronously in reverse directions to form a changing elastic force, and the changing elastic force acts on the two pedal components to form resistance to the movement of the two pedal components.

2. The stair stepper according to claim 1, wherein the damping mechanism further comprises connecting components extending along a length direction of the two slide rails, a first end of each of the connecting components is firmly connected to a corresponding one of the two pedal components, a second end of each of the connecting components is provided with a reversing part, two ends of the linear elastic element are respectively connected to the first ends of the connecting components, and a middle of the linear elastic element is wound around the reversing parts of the second ends of the connecting components, thereby extending a length of the linear elastic element.

3. The stair stepper according to claim 2, wherein the reversing part of each of the second ends of the connecting components is a rolling wheel rotatably disposed on a corresponding one of the connecting components, and the linear elastic element is wound outside the rolling wheel.

4. The stair stepper according to claim 2, wherein the first end of each of the connecting components is provided with a connecting nail, and the linear elastic element is hooked to the connecting nail, so that the linear elastic element forms a detachable connection with a corresponding one of the connecting components.

5. The stair stepper according to claim 1, wherein a connection relationship between the linear elastic element and each of the two pedal components is a detachable connection.

6. The stair stepper according to claim 1, wherein the linear elastic element is an elastic rope.

7. The stair stepper according to claim 1, wherein each of the two pedal components comprises a base part and a pedal part, the base part is slidably connected to a corresponding one of the two slide rails, the pedal part is hinged with the base part, a locking structure is provided between the pedal part and the base part, an angle between the pedal part and the base part is adjusted through hinging between the pedal part and the base part, and the angle is locked by using the locking structure, thereby adjusting an angle of the pedal part relative to the corresponding one of the two slide rails.

8. The stair stepper according to claim 7, wherein an angle adjustment manner between the pedal part and the base part is multi-gear adjustment.

9. The stair stepper according to claim 8, wherein the locking structure comprises inserting members, first adjusting holes, and a plurality of groups of second adjusting holes, the first adjusting holes are disposed in the base part, the second adjusting holes are disposed in the pedal part, the inserting members penetrate the first adjusting holes and any group of the plurality of groups of the second adjusting holes, so that the pedal part and the base part are relatively fastened.

10. The stair stepper according to claim 9, wherein each of the inserting members comprises an inserting rod and a marble disposed at one end of the inserting rod, the marble elastically protrudes from a side wall of the inserting rod, and the marble elastically expands or contracts relative to the inserting rod under an action of at least one of the first adjusting holes or the second adjusting holes.

* * * * *